US006964384B2

(12) United States Patent
Augustin

(10) Patent No.: US 6,964,384 B2
(45) Date of Patent: Nov. 15, 2005

(54) DEVICE AND METHOD FOR POSITIONING PARTS IN A FUEL INJECTOR

(75) Inventor: Ulrich Augustin, Blythewood, SC (US)

(73) Assignee: Siemens Diesel Systems Technology, Blythewood, SC (US)

( * ) Notice: Subject to any disclaimer, the term of this patent is extended or adjusted under 35 U.S.C. 154(b) by 357 days.

(21) Appl. No.: 09/903,676

(22) Filed: Jul. 13, 2001

(65) Prior Publication Data

US 2003/0010837 A1 Jan. 16, 2003

(51) Int. Cl.[7] ..... B05B 1/00

(52) U.S. Cl. ..... 239/600; 239/88; 239/533.2; 285/321; 285/305

(58) Field of Search ..... 239/88–96, 533.2–533.11, 239/124–127, 600; 129/495–509, 470; 285/305, 285/321; 411/353

(56) References Cited

U.S. PATENT DOCUMENTS 2,110,397 A * 3/1938 Kangas ..... 403/326
3,391,954 A * 7/1968 Callahan ..... 403/372
4,068,965 A * 1/1978 Lichti ..... 403/313
4,475,516 A * 10/1984 Atkins et al. ..... 239/600
4,531,496 A * 7/1985 Thomas et al. ..... 123/495
5,275,443 A * 1/1994 Klinger ..... 285/305
5,520,151 A * 5/1996 Gras et al. ..... 285/319
5,820,754 A * 10/1998 Cassidy et al. ..... 210/232
5,909,725 A * 6/1999 Balsdon et al. ..... 123/516
5,964,483 A * 10/1999 Long et al. ..... 285/305
5,979,411 A * 11/1999 Ricco ..... 123/469
6,286,768 B1 * 9/2001 Vetters et al. ..... 239/600

* cited by examiner

*Primary Examiner*—Dinh Q. Nguyen
(74) *Attorney, Agent, or Firm*—McGuireWoods LLP

(57) ABSTRACT

A device and a method for positioning the ports and passages of injector parts during an assembly of a fuel injector. The device uses a groove or a keyway with a retaining band having a key portion disposed on the retaining band. The method includes forming grooves on the parts of the fuel injector to be aligned, preventing displacement of the parts by inserting the key portion of the retaining band into the substantially aligned groove.

19 Claims, 7 Drawing Sheets

DEVICE AND METHOD FOR POSITIONING PARTS IN A FUEL INJECTOR

FIELD OF THE INVENTION

This invention is directed to a device and a method for positioning parts in a fuel injector during assembly of the injector.

BACKGROUND OF THE INVENTION

In a conventional high-pressure fuel injector arrangement, a stacking arrangement is used for assembly of the injector. The parts to be assembled may include a first portion, a spacer and a nozzle assembly. The conventional injector 10, as seen in FIG. 1, includes a first portion 101 and a second portion 102. The first portion includes a piston 102, a plunger 103. The second portion 102 includes part of the first portion 101 while also containing a nozzle assembly 104. Disposed in a stack-like configuration is a spacer 105. Two pins 106, of which only one is shown, are used to align the first portion 101, the spacer 105 and the nozzle assembly 104.

The first portion 101, spacer 105 and the nozzle assembly 104 all have inlet and outlet ports or passages that must be aligned for optimum fuel metering performance. The conventional injector, therefore, relies upon positioning pins 106 for a precise alignment between these ports or passages. However, in order to form positioning holes for the pins 106, precise machining is believed to be required for these holes. Additionally, two positioning pins are required to prevent misalignment of the assembled parts. This is believed to add to the parts' cost and count during assembly of the fuel injector. Finally, the use of positioning pins and holes is believed to require at least three steps to mount the tubular members together, adding to manufacturing inefficiency.

Thus, there is a strong need to overcome these and other problems associated with the conventional fuel injector positioning assembly arrangement.

SUMMARY OF THE INVENTION

Accordingly, the present invention is directed to a device and a procedure to permit the precise positioning of parts in the fuel injector to overcome the disadvantages of the related art.

The present invention provides a fuel injector. The fuel injector comprises a first tubular member adapted to contain a hydraulic actuator, the first tubular member being provided with a key way, a second tubular member adapted to contain a metering nozzle, the second tubular member contiguously abutting the first tubular member, the second tubular being provided with a second key way, the first key way and the second key way being substantially aligned, and a curvilinear member abutting the first and second tubular members, the curvilinear member having at least a portion adapted to be disposed in the first and second key ways.

The present invention further provides a method of positioning elements within a fuel injector. The method comprises, providing a first tubular element with a first groove disposed circumferentially thereon, a second tubular element with a second groove disposed circumferentially thereon, aligning the first groove with the second groove, and preventing any movement of the first groove relative to the second groove.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
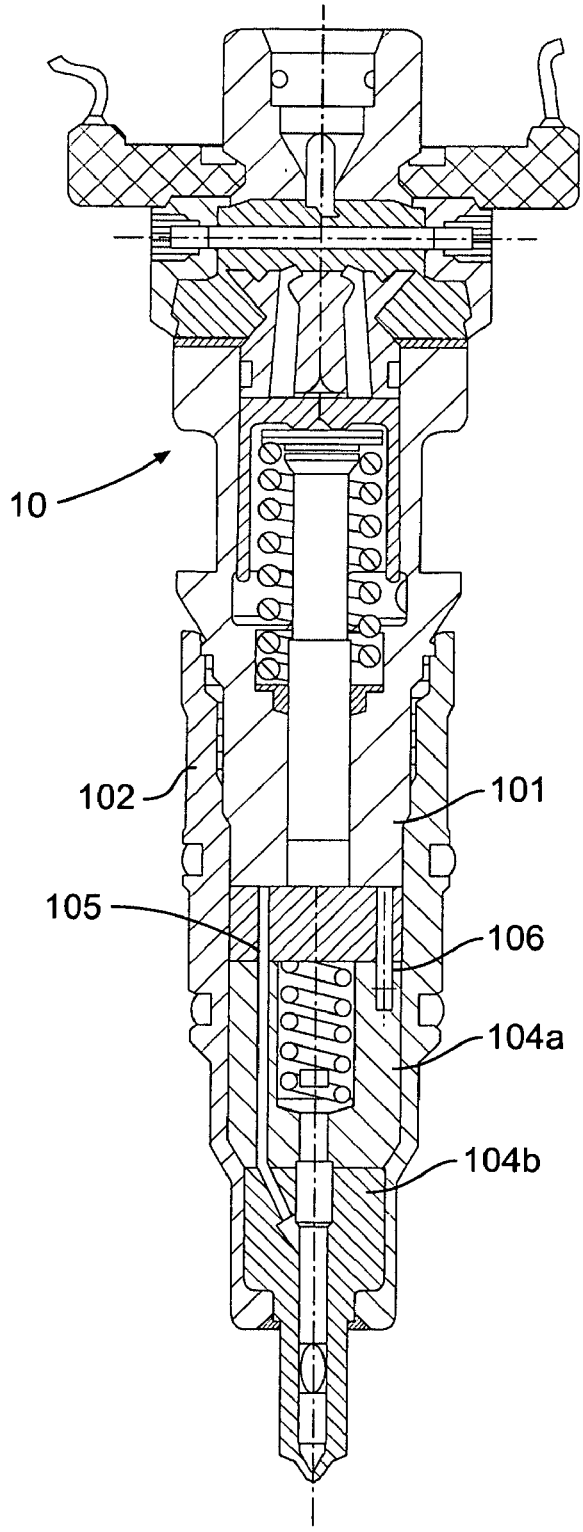
FIG. 1 is a cross-sectional view of the conventional fuel injector.
Figure 2:
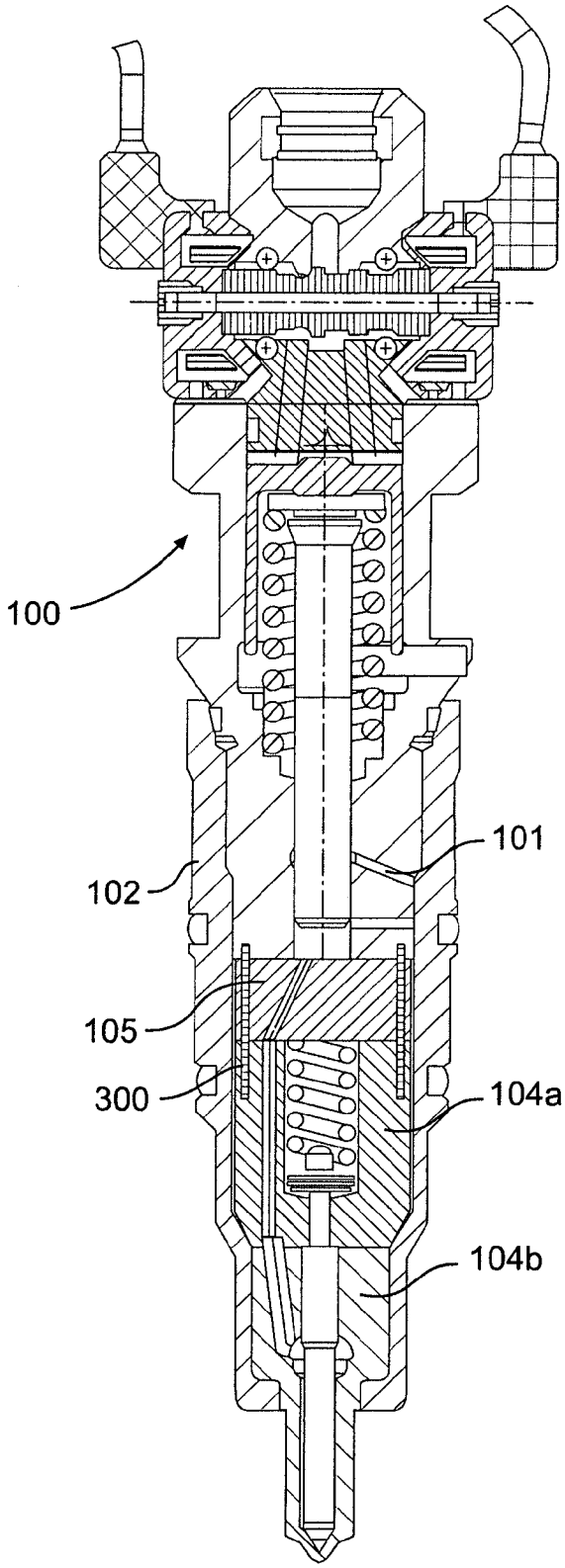
FIG. 2 shows a cross-sectional view of the fuel injector according to the present invention.
Figure 3A:
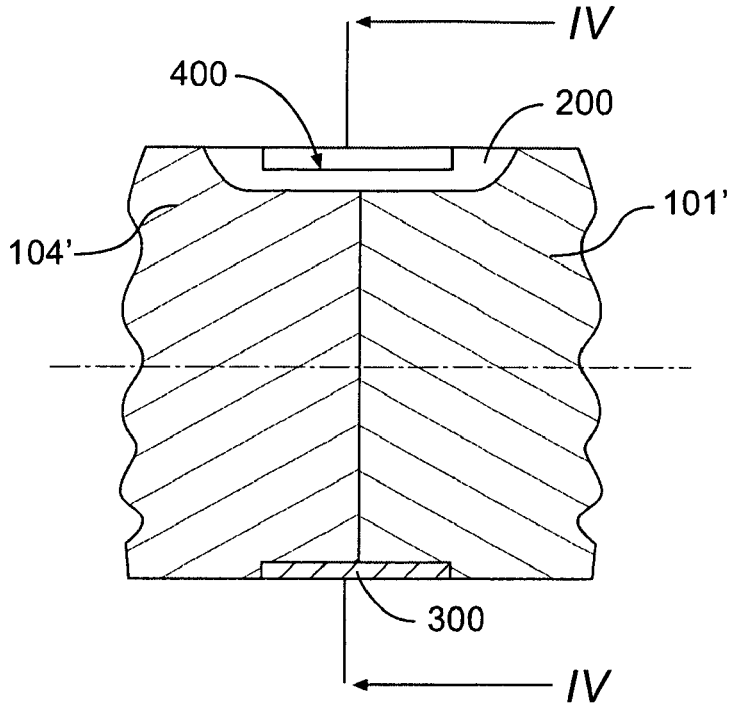
FIG. 3A shows an enlarged cross-sectional view of the first tubular member and the second tubular member and a positioning member.

Referring to FIG. 2, the fuel injector 100 shown here dispenses with positioning pins and positioning bores to align the fuel passages and fuel ports of tubular members 101 and 104 during assembly. In particular, a band 300 engages the keyways of both the members 101, 104*a* and 105 to maintain the alignments between these members. As can be seen in greater detail in FIG. 3A, a keyway or a groove 200 is formed in the respective tubular member 101' and 104'. The keyway or groove 200 permits the retaining band 300 with a key portion 400 to retain both tubular members 101' and 104' in precise alignment. Key-way or groove can be of any particular shape as long as the depth of the groove is deeper than the key portion 400 while the axial length of the key-way or groove 200 should be the same as that of the retaining band 300.

Figure 3B:
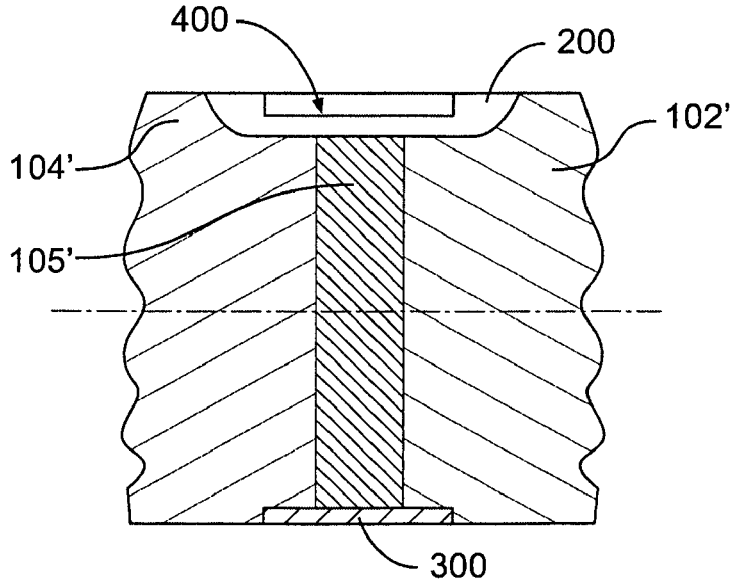
FIG. 3B shows an enlarged cross-sectional view of a third member interposed between two tubular members and a positioning member.

More than two members of the fuel injector can be aligned in this manner. In particular, FIG. 3B shows two members 102' and 104' sandwiching a third member 105'. Each of the members 102', 104' and 105' is provided with a keyway or groove 200 and key portion 400.

Figure 4:
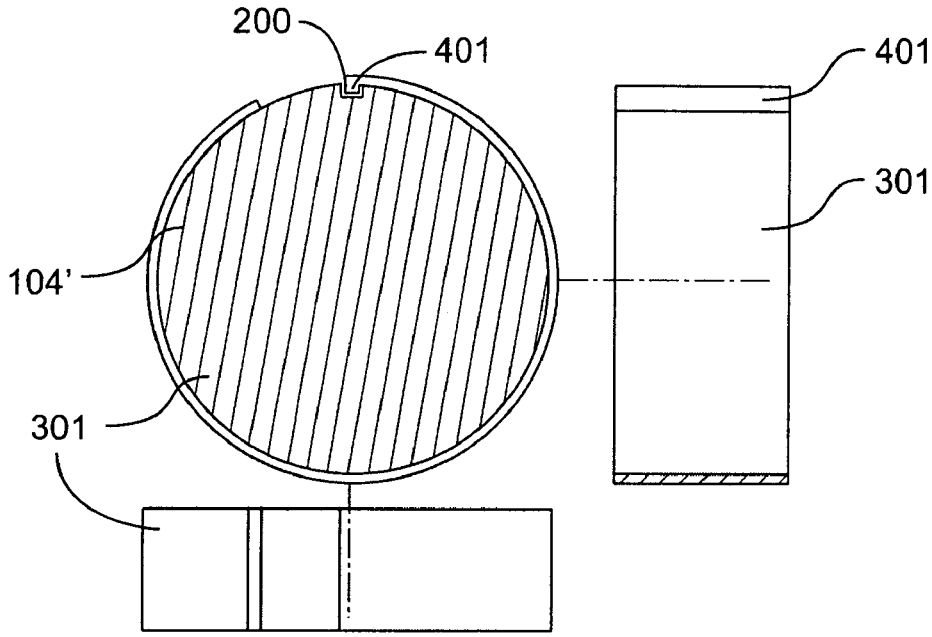
FIG. 4 is a cross-sectional view of FIG. 3A as seen by dashed lines A—A.

As shown in FIG. 4, a partially enveloping band 301 can also be used with a key 401 to retain the members of the fuel injector.

Figure 5A:
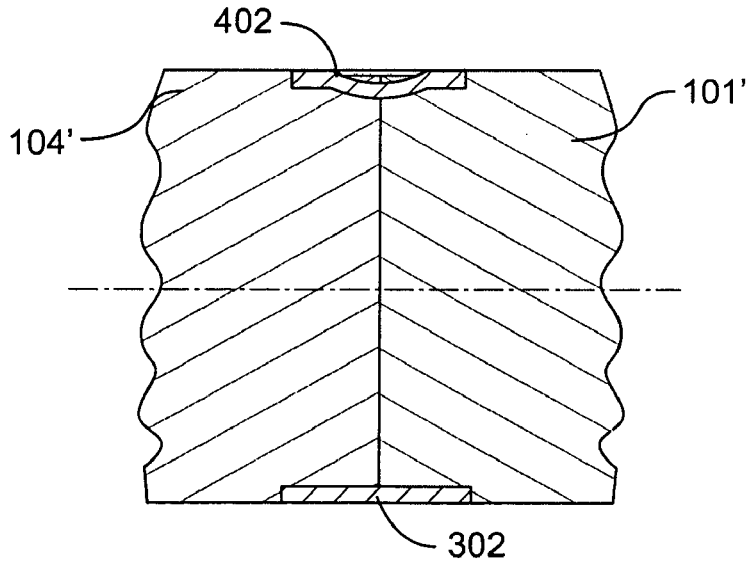
FIG. 5A is a cross-sectional view of another positioning band.
Figure 5B:
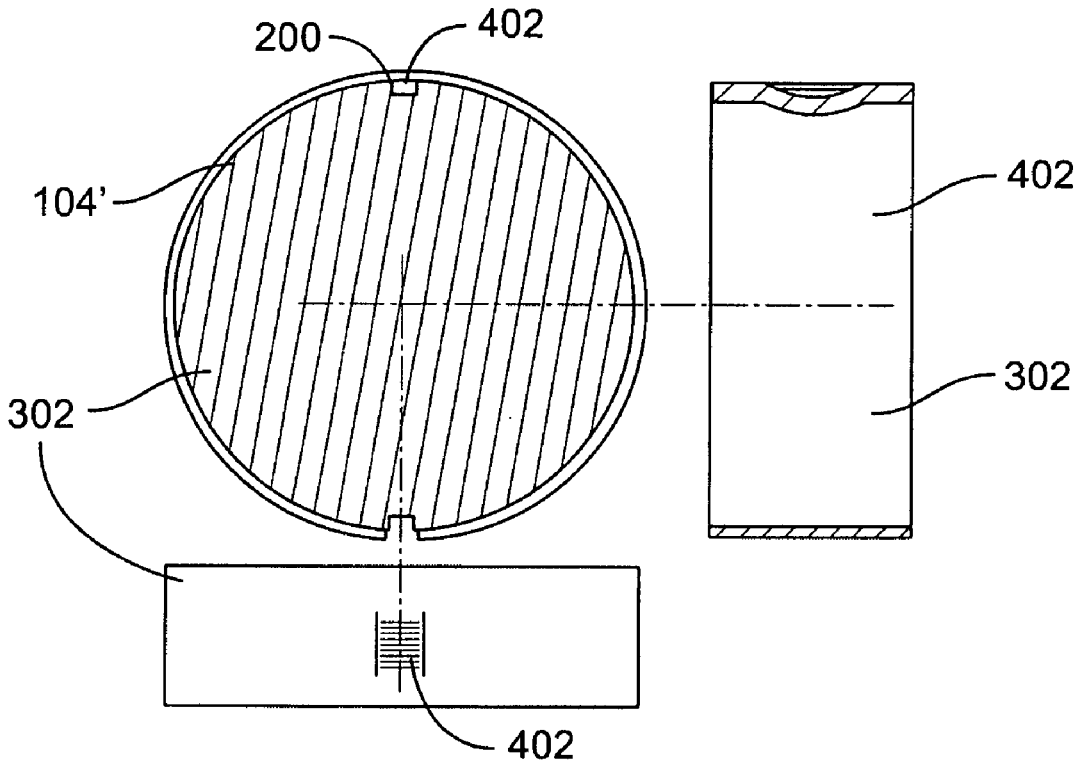
FIG. 5B is a cross-sectional view of FIG. 5A.

Rather than using a key portion 400 or 401, a stamped portion 402 can also be used with a band 302 as shown in FIGS. 5A and 5B. The stamped portion 402 resiliently extends into the keyway or groove 200.

Figure 6A:
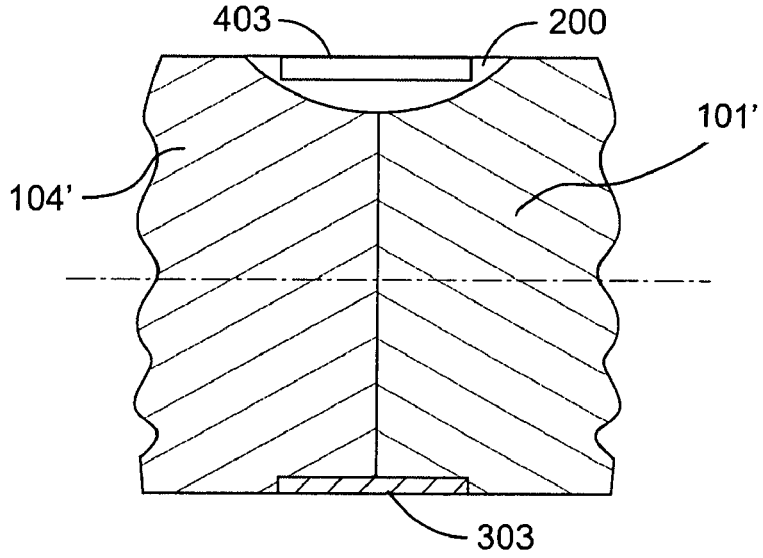
FIG. 6A is a cross-sectional view of another retaining and positioning device.
Figure 6B:
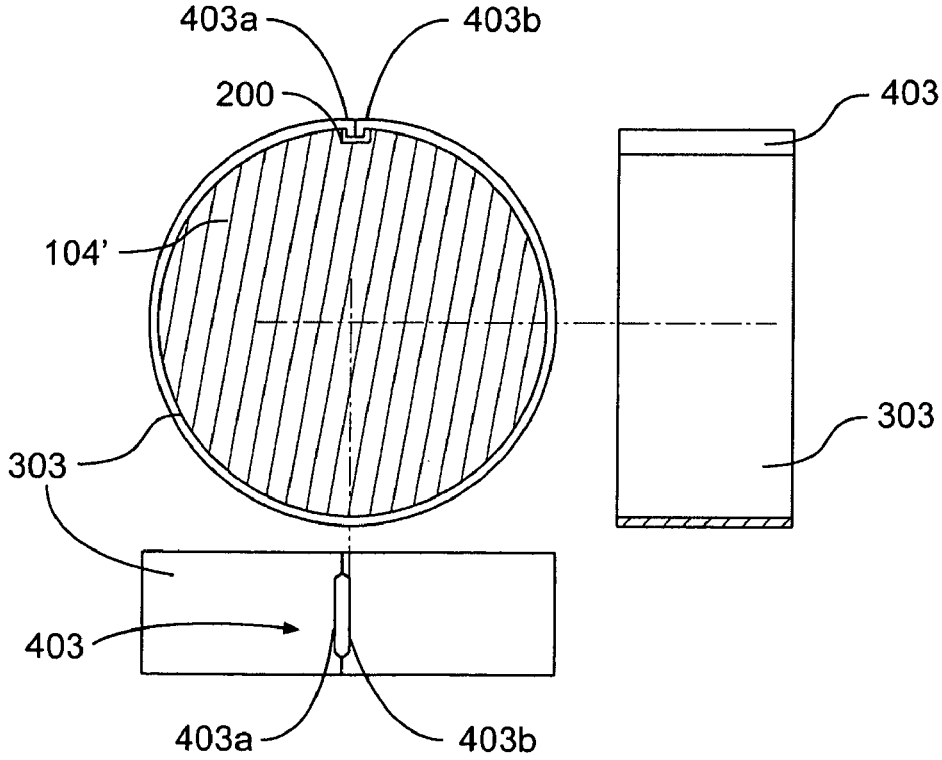
FIG. 6B is a cross-sectional view of FIG. 6A.

Alternatively, as shown in FIGS. 6A and 6B, a circular band 303 with two contiguously abutting ends 403*a* and 403*b* are disposed in the keyway or groove 200. It is believed that this configuration permits a more secure alignment of the tubular member's 102' and 104' since both ends 403*a* and 403*b* of the band 303 are in opposing contact with one another.

Figure 7:
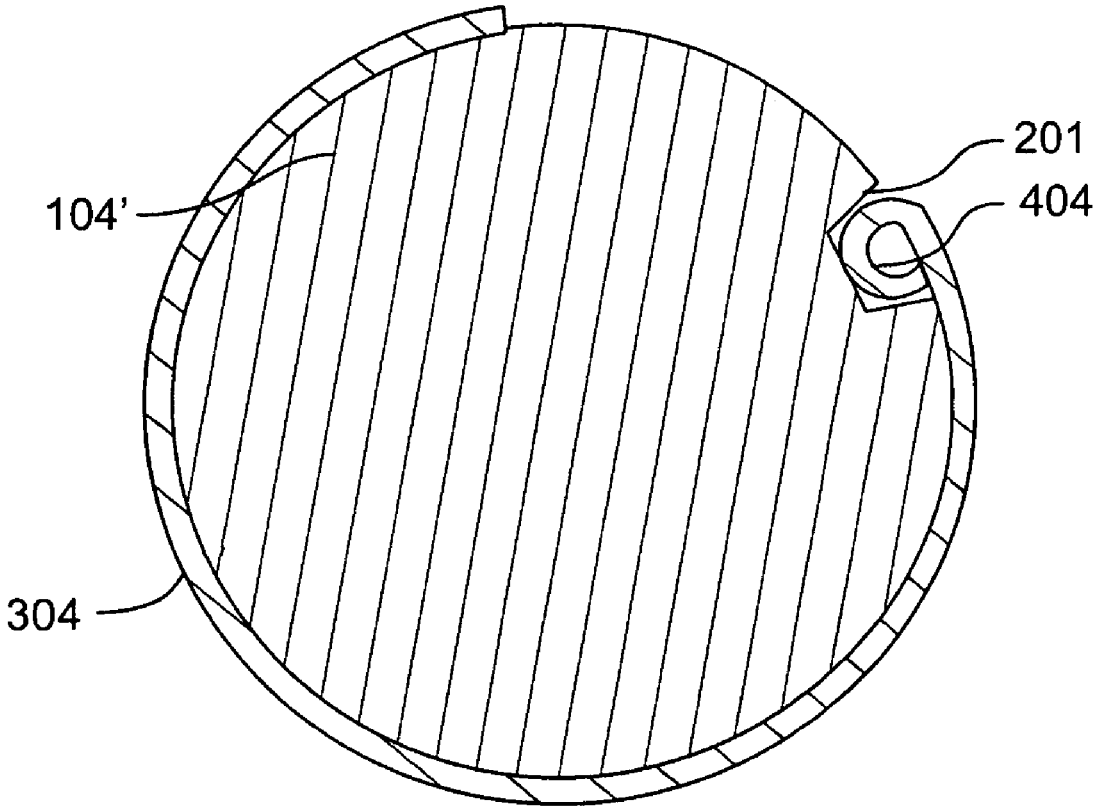
FIG. 7 shows yet another positioning and retaining arrangement.

Finally, as shown in FIG. 7, a circular band 304 with a resilient circular shaped end 404 disposed in a v-shaped key-way or groove can be used to maintain a circumferential grip on the tubular members 101' and 104'.

As can be seen by the foregoing, the benefits for using the retaining and positioning arrangements described herein are twofold: first, costly precise machining required to form the positioning holes for the pins are believed to be eliminated. Second, the two positioning pins are no longer required, thereby reducing parts count. Third, only two steps are required, i.e., lining up the tubular members and the inserting the band into the grooves rather than three or more steps that are believed to be required for the conventional arrangement.

While the claimed invention has been disclosed with reference to certain preferred embodiments, numerous modifications, alterations, and changes to the described embodiments are possible without departing from the sphere and scope of the claimed invention, as defined in the appended claims. Accordingly, it is intended that the claimed invention not be limited to the described embodiments, but that it have the full scope defined by the language of the following claims, and equivalents thereof.

What is claimed is:

1. A fuel injector comprising:

a first tubular member adapted to contain a hydraulic actuator, the first tubular member being provided with a key way;

a second tubular member adapted to contain a metering nozzle, the second tubular member contiguously abutting the first tubular member, the second tubular being provided with a second key way, the first key way and the second key way being substantially aligned; and a curvilinear member abutting the first and second tubular members, the curvilinear member having at least a portion adapted to be disposed in the first and second key ways, wherein the portion is at least a first end and a second end of the curvilinear member.

2. The fuel injector as claimed in claim 1, wherein at least one of the first end and the second end of the curvilinear member comprises a resilient member.

3. The fuel injector as claimed in claim 1, wherein the curvilinear member includes a circular band.

4. The fuel injector as claimed in claim 1, wherein the portion includes a first end and a second end of the curvilinear member.

5. The fuel injector as claimed in claim 4, wherein the curvilinear member includes a circular band.

6. The fuel injector as claimed in claim 1, wherein the portion includes a key portion fitting into a key way of the first and second tubular members.

7. The fuel injector as claimed in claim 6, wherein a portion of the key way accommodating the key portion is deeper than the key portion.

8. The fuel injector as claimed in claim 6, wherein the key portion includes a first end of the curvilinear member and the curvilinear member extends partially about the circumference of the first and second tubular members.

9. The fuel injector as claimed in claim 6, wherein the key portion includes a resilient circular shaped end fitting into a v-shaped segment of the key way.

10. The fuel injector as claimed in claim 6, wherein the curvilinear member includes a stamped portion extending into the key way of one of the first and second tubular members to maintain a grip on the first and second tubular members.

11. The fuel injector as claimed in claim 1, wherein the first and second key ways are about a circumference of the first and second tubular members.

12. The fuel injector as claimed in claim 1, wherein the curvilinear member has at least a portion adapted to be disposed substantially about the circumference of the first and second tubular members within the first and second key ways.

13. A method of positioning elements within a fuel injector, the method comprising:

providing a first tubular element with a first groove disposed thereon, a second tubular element with a second groove disposed thereon;

aligning the first groove with the second groove by abutting an end of the first tubular element with an end of the second tubular element; and preventing movement of the first groove relative to the second groove by inserting a curvilinear member in the first groove and the second groove.

14. The method of positioning as claimed in claim 13, wherein the preventing includes inserting a portion of the curvilinear member into the first and second grooves about at least a portion of a circumference of the first and second tubular members.

15. The method of positioning as claimed in claim, 14 wherein the curvilinear member comprises a resilient portion.

16. The method of positioning as claimed in claim 15, wherein the preventing movement includes inserting a resilient member into the first and second grooves of the first and second tubular members.

17. The method of positioning as claimed in claim 13, wherein the member is a curvilinear member and the preventing movement includes inserting both ends of the curvilinear member into the first and second grooves.

18. A fuel injector comprising:

a first tubular member adapted to contain a hydraulic actuator, the first tubular member being provided with a key way;

a second tubular member adapted to contain a metering nozzle, the second tubular member contiguously abutting the first tubular member, the second tubular being provided with a second key way, the first key way and the second key way being substantially aligned; and a curvilinear member abutting the first and second tubular members, the curvilinear member having at least a portion adapted to be disposed in the first and second key ways, wherein the portion includes a key portion fitting into a key way of the first and second tubular members, and the key portion is an inwardly turned first end abutting an inwardly turned second end of the curvilinear member in the key way of the first and second tubular members.

19. A fuel injector, comprising:

a first body portion having an end with a first groove extending substantially about a circumference thereabout;

a second body portion having an end with a second groove extending substantially about a circumference thereabout, the ends of the first and second body portions being in abutting contact such that the first groove and the second groove are in substantially alignment; and a member positioned in at least a portion of the first and second grooves to retain the first body portion and the second body portion in alignment.

* * * * *